US006702640B1

(12) United States Patent
Park

(10) Patent No.: US 6,702,640 B1
(45) Date of Patent: Mar. 9, 2004

(54) BLOCK TOY

(76) Inventor: Young Ouk Park, (10/4) 109-144, Hoegi-dong, Tongdaemoon-gu, Seoul 130-050 (KR)

( * ) Notice: Subject to any disclaimer, the term of this patent is extended or adjusted under 35 U.S.C. 154(b) by 0 days.

(21) Appl. No.: 10/149,561

(22) PCT Filed: Nov. 6, 2000

(86) PCT No.: PCT/KR00/01268

§ 371 (c)(1),
(2), (4) Date: Aug. 23, 2002

(87) PCT Pub. No.: WO01/34263

PCT Pub. Date: May 17, 2001

(30) Foreign Application Priority Data

Nov. 11, 1999 (KR) ..... 1999/24672 U

(51) Int. Cl.[7] ..... A63H 33/04
(52) U.S. Cl. ..... 446/85; 52/655.1; 446/105
(58) Field of Search ..... 446/85, 97, 102, 446/105, 106, 107, 111, 112, 113, 114–116, 119, 122, 124; 52/655.1, 655.2, 656.9; 403/171, 217

(56) References Cited

U.S. PATENT DOCUMENTS 3,632,147 A * 1/1972 Finger ..... 287/189.36
3,982,841 A * 9/1976 Endzweig ..... 403/19
3,998,003 A 12/1976 Rosenbaum
4,129,975 A * 12/1978 Gabriel ..... 52/648
4,676,043 A * 6/1987 Grimm ..... 52/648
5,542,871 A * 8/1996 Gabriel ..... 446/126
5,599,221 A * 2/1997 Gabriel ..... 446/128
6,004,182 A * 12/1999 Pasin ..... 446/105

* cited by examiner

*Primary Examiner*—Jacob K. Ackun
*Assistant Examiner*—Jamila Williams
(74) *Attorney, Agent, or Firm*—Bell, Boyd & Lloyd LLC

(57) ABSTRACT

Disclosed is a block toy having a plurality of coupling beads each having a plurality of insertion grooves on the outer peripheral surfaces thereof, a plurality of coupling bars connecting the plurality of coupling beads to form predetermined three dimensional frameworks, and a plurality of assembling plates covering the spaces among the predetermined three-dimensional frameworks to form a whole shape, characterized in that each of all outer peripheral surfaces of each of the plurality of coupling beads is made with 8 sides along vertical and horizontal directions of a radially outer periphery thereof from the center thereof, thereby allowing the plurality of coupling beads to have basic angles 45°, 60° and 90°. Thereby, the assembling work of the plurality of coupling beads, the plurality of coupling bars and the plurality of assembling plates can be carried out in simple and easy manners and a delicate and complicated structure can be built.

7 Claims, 5 Drawing Sheets

BLOCK TOY

This application is a 371 of PCT/KR00/01268 filed Nov. 6, 2000.

TECHNICAL FIELD

The present invention relates to a block toy and more particularly, to a block toy which forms 8 outer peripheral surfaces along vertical and horizontal directions of a radially outer periphery of each of a plurality of coupling beads from the center thereof and enables the basic angle of a plurality of coupling bars each inserted vertically into the surface of the coupling bead to be at 45°, 60° and 90°, thereby allowing a desired model of all kinds of shapes to be assembled in a simple manner.

BACKGROUND ART

Generally, a block toy is composed of a plurality of spherical coupling beads and a plurality of coupling bars connecting the plurality of coupling beads. Using the plurality of coupling beads and the plurality of coupling bars of the block toy, a building or bridge of a desired shape can be assembled.

By way of example, there is provided a conventionally known arm type of block toy as disclosed in Japanese Utility Model Laid-Open Application No. 57-67798, which is composed of a plurality of coupling beads having 18 flat faces and a plurality of arms (coupling bars) each having an absorption plate to the flat faces of each coupling bead, such that the absorption plate of each arm is absorbed on the flat faces of each of the coupling beads, respectively, thereby forming a three-dimensional structure.

Since the above-mentioned conventional block toy absorbs the absorption plate of the arm onto the flat faces of each coupling bead, however, the absorbed state is not rigid and thus, only a small and simple structure can be formed. Additionally, the arms are absorbed on the 18 flat faces at an angle of about 60°, thereby making it difficult to form a delicate and complicated structure.

There is also provided a conventionally known multipurpose block toy as disclosed in Korean Utility Model Laid-Open Application No. 87-6490, which is composed of a plurality of coupling beads of a ball shape on which an insertion groove is formed, a plurality of coupling bars each connected to the coupling beads and having insertion grooves into which a plurality of assembling plates are inserted at different angles and the plurality of assembling plates adapted to be inserted into the insertion grooves of each coupling bar.

However, since the above-referenced conventional block toy forms such the plurality of insertion grooves in an irregularly arranging manner on the outer periphery of the coupling bead of the ball shape to thereby connect the plurality of coupling beads by the coupling bars, the angles of the coupling bars inserted into the coupling beads are not uniform, thereby making it difficult to build a desired structure. Further, since the coupling bar forms the insertion grooves thereon in a length direction, there occurs a problem that the assembling plate is not well inserted into the insertion grooves of the coupling bar.

Moreover, there is provided a conventionally known block toy coupler as disclosed in Korean Utility Model Laid-Open Application No. 86-1394, which is composed of a plurality of coupling beads with a plurality of through holes on the outer periphery and a plug having a pair of insertion bars formed by the protrusion of a protruded member with a reentrant groove on both ends thereof, for the purpose of connecting the plurality of coupling beads with the through holes.

Since the above-referenced conventional block toy coupler inserts the insertion bars into the through holes formed irregularly on each of the coupling beads, however, a simple and easy structure is formed but a delicate and complicated structure is not well formed. Particularly, the plug with the insertion bars on the both ends thereof is manufactured in a complicated manner, thereby accompanying the difficulties of the manufacturing work.

DISCLOSURE OF INVENTION

It is, therefore, an object of the present invention to provide a block toy capable of carrying out an assembling work of a plurality of coupling beads, a plurality of coupling bars and a plurality of assembling plates in a simple manner, thereby making it possible to build a delicate and complicated structure.

According to a first aspect of the present invention, there is provided a block toy having a plurality of coupling beads each having a plurality of insertion grooves on the outer peripheral surfaces thereof, a plurality of coupling bars connecting the plurality of coupling beads to form predetermined three-dimensional frameworks, and a plurality of assembling plates covering the spaces among the predetermined three-dimensional frameworks to form a whole shape, characterized in that each of all outer peripheral surfaces of each of the plurality of coupling beads is made with 8 sides along vertical and horizontal directions of a radially outer periphery thereof from the center thereof, thereby allowing the plurality of coupling bars each inserted into the plurality of insertion grooves of each of the plurality of coupling beads to have basic angles at 45°, 60° and 90°.

It is preferable that each of the plurality of insertion grooves on each of the plurality of coupling beads is formed by a predetermined depth towards the center point of the coupling bead, such that each of the plurality of coupling bars is inserted in a perpendicular direction relative to each surface of each of the plurality of coupling beads.

It is desirable that each of said coupling beads is a cylindrical shape and has a curved outer peripheral surface and each of the assembling plates is provided on the edges thereof with a plurality of reentrant grooves on the portion assembled with each of the coupling bars, such that it can cover the outer peripheral surface of each of the coupling bars and is assembled with the coupling bar.

Each of the assembling plates is of a curved surface shape, so that it is assembled to each of the coupling bars, thereby allowing the whole block toy to be of a curved surface shape.

According to a second aspect of the present invention, there is provided a block toy having a plurality of coupling beads each having a plurality of insertion grooves on the outer peripheral surfaces thereof, a plurality of coupling bars connecting the plurality of coupling beads to form predetermined three-dimensional frameworks, and a plurality of assembling plates covering the spaces among the predetermined three-dimensional frameworks to form a whole shape, characterized in that each of the assembling plates is provided on the edges assembled to each of the coupling bars with a plurality of protrusions which are formed in a zigzag order to take a "V" shape, such that the plurality of assembling plates cover the outer peripheral surfaces of the plurality of coupling bars along the outer peripheral surfaces of the coupling bars of the cylindrical shape and are assembled therewith.

In order to assemble each of the assembling plates with the coupling bars, each edge of each of said assembling plates is divided into four areas on which the four protrusions are formed and a fine clearance is desirably formed between the protrusions.

According to a third aspect of the present invention, there is provided a block toy having a plurality of coupling beads each having a plurality of insertion grooves on the outer peripheral surfaces thereof, a plurality of coupling bars connecting the plurality of coupling beads to form predetermined three-dimensional frameworks, and a plurality of assembling plates covering the spaces among the predetermined three-dimensional frameworks to form a whole shape, characterized in that each of all outer peripheral surfaces of each of the plurality of coupling beads is made with 12 sides along vertical and horizontal directions of a radially outer periphery thereof from the center thereof, thereby allowing the plurality of coupling bars each inserted into the plurality of insertion grooves of each of the plurality of coupling beads to have basic angles at 30°, 60° and 90°.

According to a fourth aspect of the present invention, there is provided a block toy having a plurality of coupling beads each having a plurality of insertion grooves on the outer peripheral surfaces thereof, a plurality of coupling bars connecting the plurality of coupling beads to form predetermined three-dimensional frameworks, and a plurality of assembling plates covering the spaces among the predetermined three-dimensional frameworks to form a whole shape, characterized in that each of all outer peripheral surfaces of each of the plurality of coupling beads is made with 16 sides along vertical and horizontal directions of a radially outer periphery thereof from the center thereof, thereby allowing the plurality of coupling bars each inserted into the plurality of insertion grooves of each of the plurality of coupling beads to have basic angles at 22.5°, 45°, 60°, 67.5° and 90°.

BEST MODE FOR CARRYING OUT THE INVENTION

Figure 1:
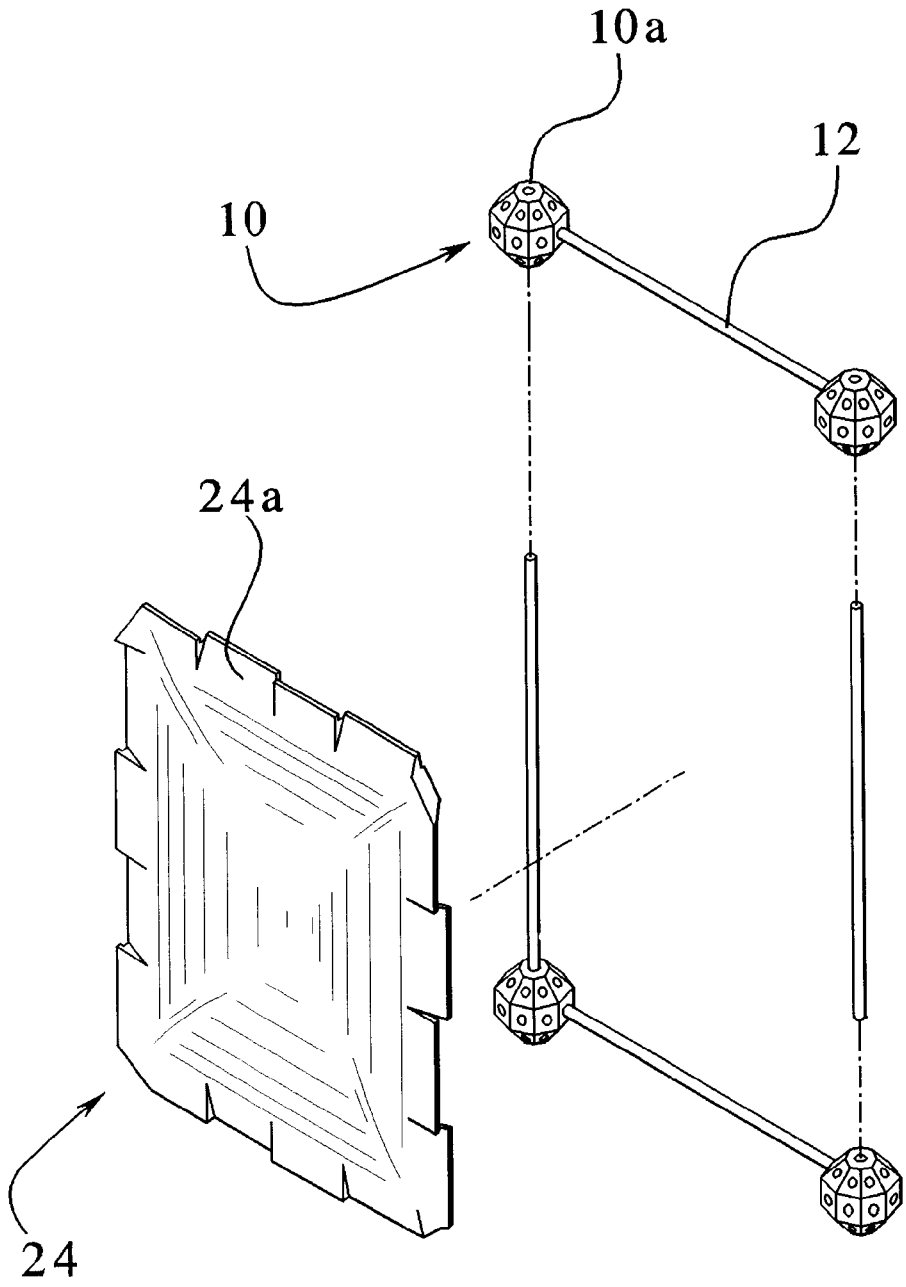
FIG. 1 is an exploded perspective view illustrating the construction of a block toy according to the present invention.
Figure 2:
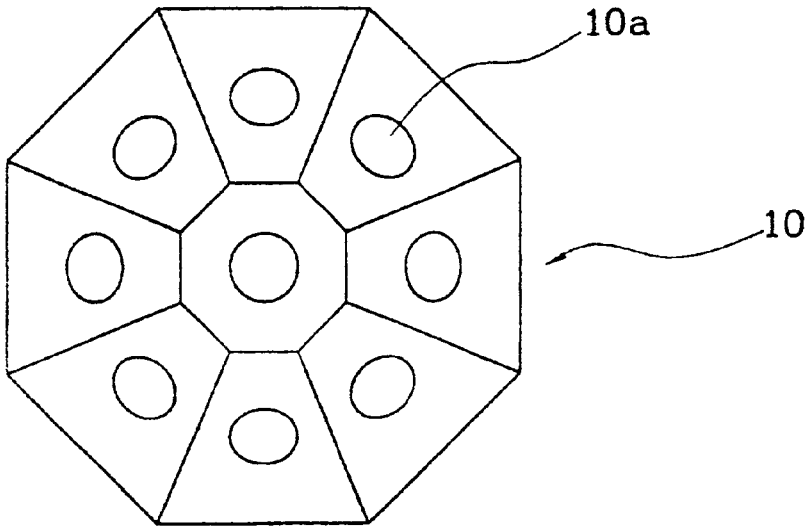
FIG. 2 is a plan view illustrating an example of a coupling bead in the block toy of the present invention.
Figure 3:
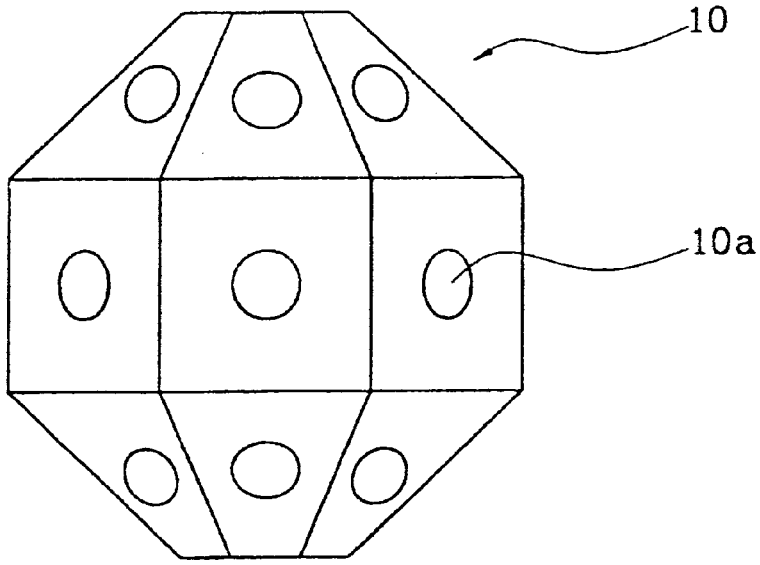
FIG. 3 is a top view of the coupling bead.

Now, a block toy of the present invention will be hereinafter discussed with reference to the accompanying drawings.

As shown in FIGS. 1 to 4, the block toy of the present invention is composed of a plurality of coupling beads 10 each having a plurality of insertion grooves 1*a* on the outer peripheral surfaces thereof, a plurality of coupling bars 12 connecting the plurality of coupling beads 10 to form predetermined three-dimensional frameworks, and a plurality of assembling plates 14, 24 covering the spaces among the predetermined three-dimensional frameworks to form a whole structure shape.

Each of the coupling beads 10 of a spherical shape is assembled with the plurality of coupling bars 12 at basic angles at 45°, 60° and 90° between the coupling bars 12 inserted into the insertion grooves 10*a* and has 8-sided outer peripheral surfaces along vertical and horizontal directions of a radially outer periphery thereof, respectively.

Each of the plurality of insertion grooves on each coupling bead 10 is formed by a predetermined depth towards the center point of the coupling bead 10 on the center of each surface thereof, such that each of the plurality of coupling bars 12 is inserted in a perpendicular direction relative to each surface of each coupling bead 12.

The predetermined depth of the insertion groove 10*a* is formed so that the inserted coupling bar 12 is not easily separated from the insertion groove 10*a* when an external shock is applied.

Each of the coupling bars 12 has a curved outer peripheral surface, thereby taking a cylindrical shape, in order to be assembled with each of the plurality of assembling plates 14 and 24 in an easy manner. And, it is desirable that the plurality of coupling bars 12 having different lengths are provided in accordance with the angles formed during the assembling with the plurality of coupling beads 10.

For example, it is assumed that a basic unit of the coupling bar 12 is '1' and in case where a regular square is built by using the coupling bar of unit of '1', there are provided the coupling bars having a length of the root of 2 for connecting the diagonal lines of the regular square.

If the basic unit of the coupling bar is changed, the coupling bars should be provided according to the unit length of the used coupling bar.

Each of the assembling plates 14 and 24 is coupled to the frameworks of the structure built by the connections of the coupling beads 10, such that the structure takes a complete shape. The triangular and square assembling plates are provided according to the assembling shape of the coupling bars 12.

Each of the assembling plates 14 is provided with a plurality of reentrant grooves 14*a* on the edge portions assembled with each of the coupling bars 12, for the purpose of being easily assembled to the coupling bars 12 of the cylindrical shape.

And, each of the assembling plates 24 is provided on the edges assembled to each of the coupling bars, except the reentrant edges with a plurality of protrusions 24*a* that are formed in a zigzag order to take a "V" shape.

Each of the assembling plates (not shown) is of a curved surface shape, so that when it is assembled to each of the coupling bars 12, the whole block toy takes a curved surface shape.

Under the above construction, the coupling bead 10 is disposed at a predetermined position and the coupling bar is inserted into the two insertion grooves 10*a* of the coupling bead 10 that are at an angle of 90° among the 8 sides formed in a horizontal direction.

Thus, a pair of coupling beads 10 on which the coupling bars 12 are inserted and another pair of coupling beads 10 on which no coupling bar is connected are assembled to each other, thereby building a square structure.

Using the above building manner, the coupling bar 12 is inserted into the insertion grooves 10*a* on the top and bottom surfaces of the coupling bead 10 and into the insertion grooves 10*a* that are at an angle of 90° among the 8 sides on the center thereof in a horizontal direction, respectively, thus to build a regular hexahedron. Based upon the regular hexahedron, a large number of regular hexahedron combinations may be built.

Figure 4:
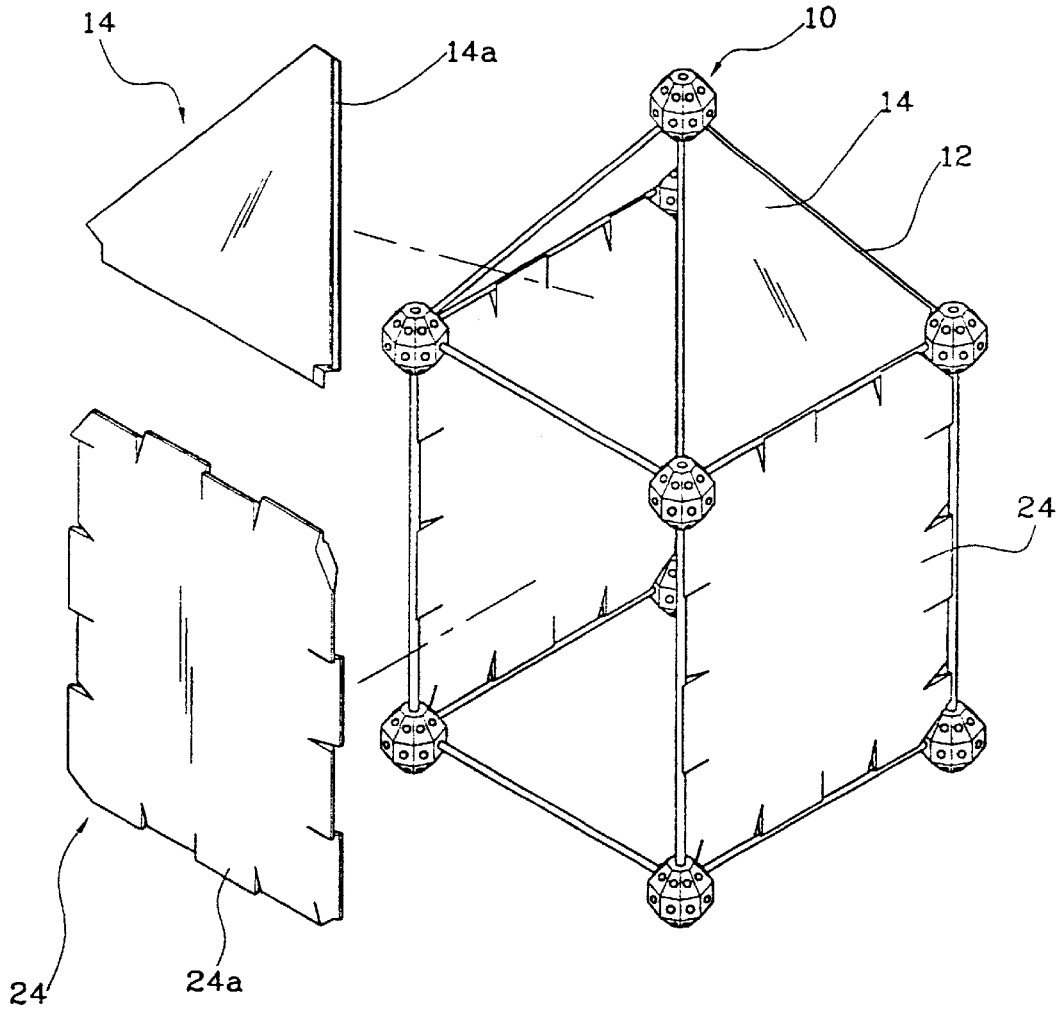
FIG. 4 is an exploded perspective view illustrating the block toy according to the present invention in an assembled state.

Further, as shown in FIG. 4, the coupling bars 12 are inserted into the insertion grooves 10*a* on the upper sides adjacent to the surface of each coupling bead 10 corresponding to the upper edges of the regular hexahedron, and the coupling bead 10 is connected to the point on which the coupling bars 12 are met, thereby building a regular square pyramid.

On the other hand, the basic unit of the coupling bar 12 is set long or short, thereby building a right-angled hexahedron.

Using the coupling beads 10 and the coupling bars 12, the structure of a desired shape is built, and the assembling plates 14 and 24 are covered on the spaces formed between the coupling bars 12, thereby completing the whole shape of the structure.

In this way, the assembling plates 14 and 24 can be assembled with the space portions of the structure in rigid and close manners by the formation of the plurality of reentrants grooves 14*a* and the plurality of protrusions 24*a* of the "V" shape on the edges coupled to the coupling bars 12.

On the other hand, each of the coupling beads 10 has the 8 outer peripheral surfaces according to its diameters, but may have 8 or more outer peripheral surfaces for the purpose of building a more delicate and complicated structure.

Figure 5:
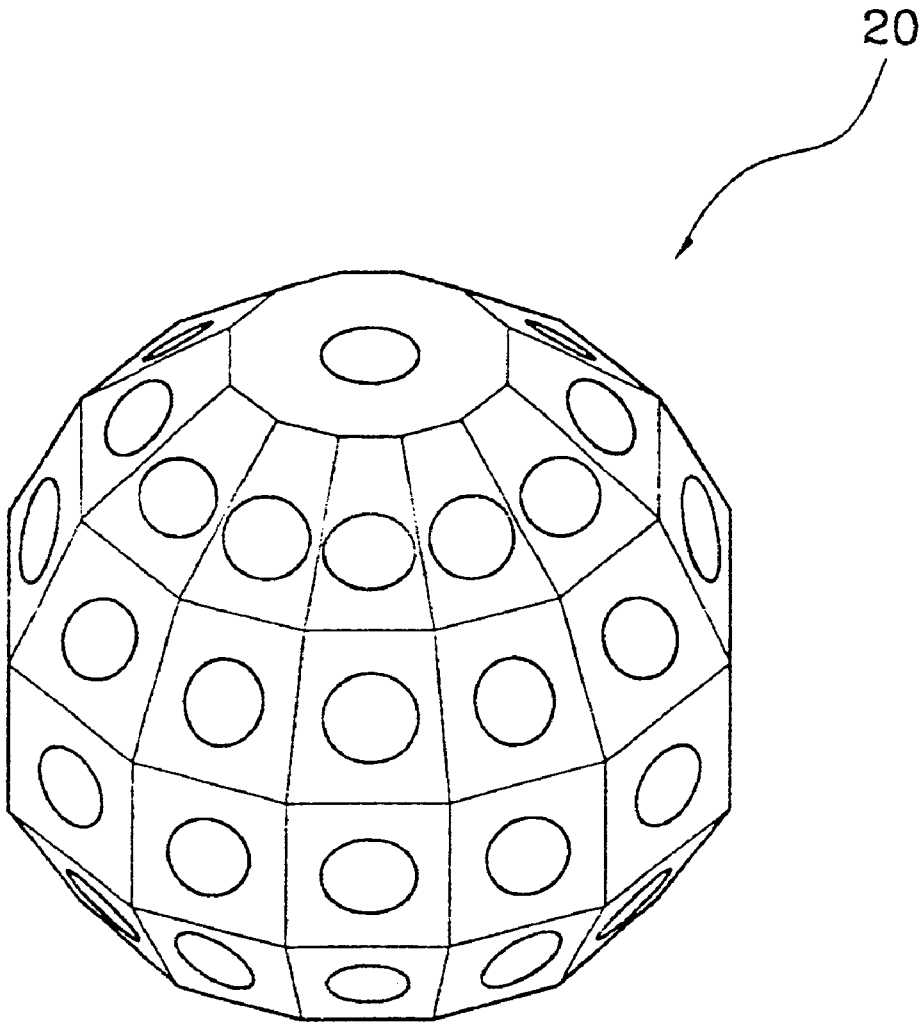
FIG. 5 is a perspective view illustrating another example of the coupling bead in the block toy of the present invention.
Figure 6:
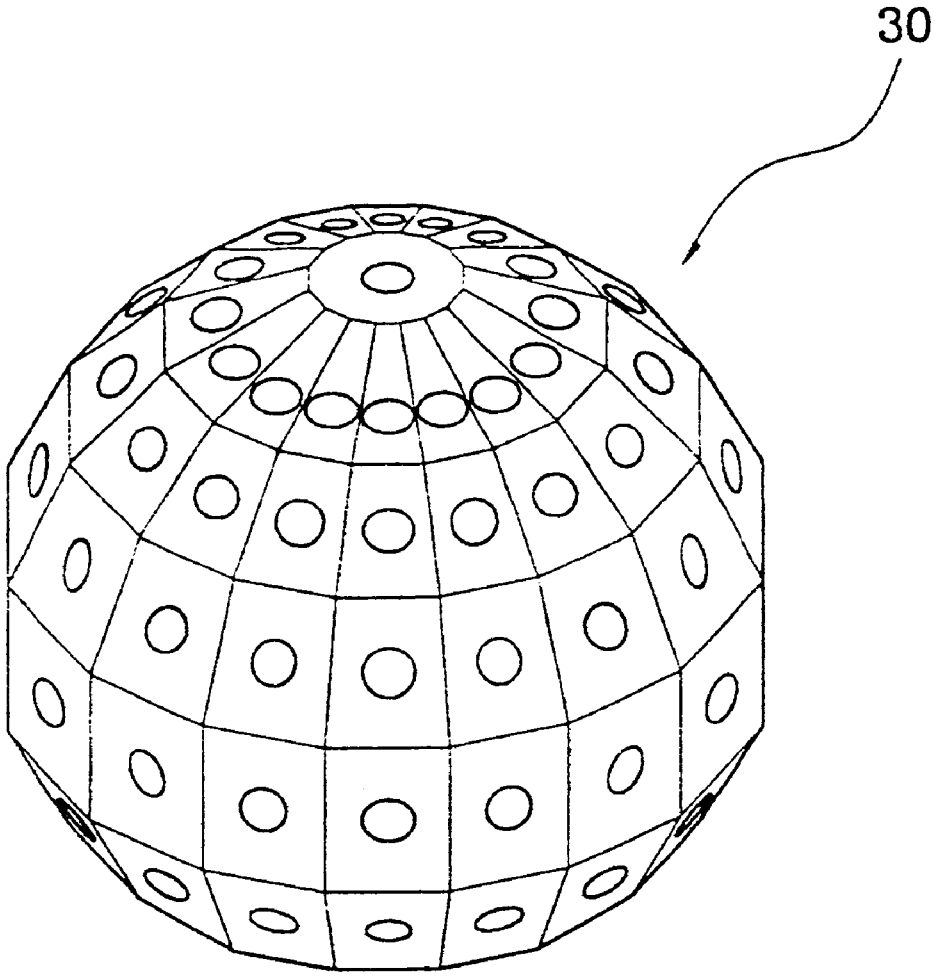
FIG. 6 is a perspective view illustrating yet another example of the coupling bead in the block toy of the present invention.

By way of example, FIG. 5 shows a coupling bead 20 having 12 outer peripheral surfaces and FIG. 6 shows a coupling bead 30 having 16 outer peripheral surfaces.

INDUSTRIAL APPLICABILITY

As discussed above, a block toy according to the present invention includes a plurality of coupling beads each having 8 outer peripheral surfaces according to its diameters and a plurality of assembling plates each having a plurality of reentrant grooves on the edges thereof coupled to a plurality of coupling bars, whereby the assembling work of the plurality of coupling beads, the plurality of coupling bars and the plurality of assembling plates can be carried out in simple and easy manners and a delicate and complicated structure can be built.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A block toy comprising:

a plurality of coupling beads each having 8 sides and a plurality of insertion grooves on outer peripheral surfaces thereof;

a plurality of coupling bars for connecting said plurality of coupling beads to form a predetermined three-dimensional framework, said coupling bars insertable into said insertion grooves of each of said coupling beads to have basic angles at 45°, 60° and 90°; and a plurality of assembling plates for covering spaces of the predetermined three-dimensional framework to form a whole shape, each of said assembling plates having a curved surface shape, so that when said assembling plates are connected to each of said coupling bars, the block toy defines a curved surface shape.

2. A block toy according to claim 1, wherein each of said insertion grooves on each of said coupling beads is defined by a predetermined depth towards a center point of the coupling bead, such that each of said coupling bars is inserted in a perpendicular direction relative to each surface of said coupling beads.

3. A block toy according to claim 1, wherein each of said coupling beads is a cylindrical shape and has a curved outer peripheral surface, and each of said assembling plates is provided with a plurality of reentrant grooves on edges for engaging each of said coupling bars.

4. A block toy comprising:

a plurality of coupling beads each comprising a plurality of insertion grooves on outer peripheral surfaces thereof;

a plurality of coupling bars for connecting said plurality of coupling beads to form a predetermined three-dimensional framework; and a plurality of assembling plates for covering spaces of the predetermined three-dimensional framework to form a whole shape, wherein each of said assembling plates is provided with a plurality of "V" shaped protrusions on edges for engaging each of said coupling bars.

5. A block toy according to claim 4, wherein each edge of said assembling plates is divided into four areas on which four protrusions are formed for engaging said coupling bars.

6. A block toy comprising:

a plurality of coupling beads each having 12 sides and comprising a plurality of insertion grooves on outer peripheral surfaces thereof;

a plurality of coupling bars for connecting said plurality of coupling beads to form a predetermined three-dimensional framework, said coupling bars insertable into said insertion grooves of each of said coupling beads to have basic angles at 30°, 60° and 90°; and a plurality of assembling plates for covering spaces of the predetermined three-dimensional framework to form a whole shape.

7. A block toy comprising:

a plurality of coupling beads each having 15 sides and comprising a plurality of insertion grooves on outer peripheral surfaces thereof;

a plurality of coupling bars for connecting said plurality of coupling beads to form a predetermined three-dimensional framework, said plurality of coupling bars insertable into said plurality of insertion grooves of each of said plurality of coupling beads to have basic angles at 22.5°, 45°, 60°, 67.5° and 90°; and a plurality of assembling plates for covering spaces of the predetermined three-dimensional framework to form a whole shape.

* * * * *